US006789471B2

(12) United States Patent
Zimmer et al.

(10) Patent No.: US 6,789,471 B2
(45) Date of Patent: Sep. 14, 2004

(54) DEVICE FOR PRINTING ON PAPER OR PLATE-SHAPED MATERIALS

(75) Inventors: Michael Zimmer, Beerenfeldstr. 11, D-66133 Saarbrücken (DE); Birgit Lattermann, Riedstadt (DE); Bernd Schultheis, Schwabenheim (DE)

(73) Assignees: Michael Zimmer, Saarbrücken (DE); Schott Glas, Mainz (DE)

( * ) Notice: Subject to any disclaimer, the term of this patent is extended or adjusted under 35 U.S.C. 154(b) by 28 days.

(21) Appl. No.: 09/760,874

(22) Filed: Jan. 16, 2001

(65) Prior Publication Data

US 2001/0039890 A1 Nov. 15, 2001

(30) Foreign Application Priority Data

Jan. 15, 2000 (DE) ..... 100 01 452

(51) Int. Cl.[7] ..... B41F 17/00

(52) U.S. Cl. ..... 101/41; 101/DIG. 37; 399/308

(58) Field of Search ..... 101/35, 36, 37, 101/41, 44, 126, DIG. 37, 489, 232; 399/297, 302, 308, 310, 313, 319, 303, 307

(56) References Cited

U.S. PATENT DOCUMENTS

| | | | | |
|---|---|---|---|---|
| 5,604,570 A | * | 2/1997 | Jeran et al. | 399/116 |
| 5,890,043 A | | 3/1999 | Uehara | |
| 6,360,071 B1 | * | 3/2002 | Tomizawa | 399/302 |

FOREIGN PATENT DOCUMENTS

| | | |
|---|---|---|
| EP | 727 778 | 8/1996 |
| EP | 834 784 | 4/1998 |
| EP | 647 885 | 7/1999 |

* cited by examiner

*Primary Examiner*—Ren Yan
(74) *Attorney, Agent, or Firm*—Pauley Petersen & Erickson

(57) ABSTRACT

A device for printing on paper or plate-shaped materials, such as plates made of glass, ceramic, glass-ceramic or plastic materials, having a transport device for the plates to be printed and an electrostatic, in particular an electrographic, printing device arranged above it. With the printing process of this invention, in an efficient manner, a conveying and centering unit of a screen-printing device is combined as a transport device with the electrostatic, in particular the electrographic, printing device, which is compatible with the upper unit of the screen-printing device.

13 Claims, 2 Drawing Sheets

DEVICE FOR PRINTING ON PAPER OR PLATE-SHAPED MATERIALS

BACKGROUND OF THE INVENTION

1. Field of the Invention

This invention relates to a device for printing on paper or plate-shaped materials, such as plates made of glass, ceramic, glass-ceramic or plastic materials, having a transport device for the plates to be printed and an electrostatic, in particular an electrographic, printing device arranged above the transport device.

2. Description of Related Art

Such devices are known in various embodiments, as shown in European Patent References EP 0 834 784 A1, EP 0 727 778 A1 and EP 0 647 885 A1, and in U.S. Pat. No. 5,890,043. It is possible with these devices to apply toners containing ceramic inks to transfer media, which are used for decorating ceramic articles, such as plates, cups and the like.

With these devices the required print accuracy is only insufficiently achieved when directly printing on plate-like materials, such as glass, ceramic, glass-ceramic or plastic plates.

Screen-printing devices, which have a table-like conveying and centering unit as the transport device for the workpieces to be printed on, are also often employed for printing on such plate-shaped materials. An upper unit having a receptacle for a screen frame and a linear drive for a printing doctor blade is assigned to the base unit. Such screen-printing devices are sufficiently described in literature and their functioning is known. The conveying and centering unit in particular of such screen-printing devices today has a large degree of accuracy, repetitive accuracy and dependability. But the frequent screen changes in connection with changing print orders is disadvantageous, along with the odor from solvents, the solvent residue and the screen-printing residue.

SUMMARY OF THE INVENTION

It is one object of this invention to provide a device of the type mentioned above but in which a flexible printing process can be achieved in an efficient manner.

In accordance with this invention, this object is achieved with a conveying and centering unit of a screen-printing device which is combined as a transport device with the electrostatic, in particular the electrographic, printing device, which is compatible with the upper unit of the screen-printing device.

It is possible with this combination of a transport device of a screen-printing device with an electrostatic, in particular an electrographic, printing device, to fill changing print orders in an efficient manner even for smallest lots without having to accept the disadvantages of the screen-printing device. If the upper unit of the screen-printing device is compatible with the electrostatic, in particular the electrographic, printing device, the conveying and centering unit of a screen-printing device can be used for both devices for screen printing and electrostatic or electrographic printing methods.

In one embodiment, the electrostatic or electrographic printing device, the same as the upper unit of the screen-printing device, can be vertically lifted off the conveying and centering unit or tilted up from one end in order to simplify access to the conveying and centering unit. In this case the electrostatic or electrographic printing device, the same as the upper unit of a screen-printing device, can be arranged in a frame, which is connected with the conveying and centering unit and can be adjusted with respect to the latter.

In accordance with one embodiment, the structure of the electrostatic or electrographic printing device can be such that the electrostatic printing device has an endless belt, which is guided over two rollers and is tensed. An electrostatic pushbutton with an optical photoconductor roller and a developing unit is arranged above the upper run of the endless belt. On the side of the lower run of the endless belt facing away from the conveying and centering unit the toner can be transferred by a linearly guided electrostatic doctor blade unit from the endless belt to the workpiece to be printed.

For improving the linear toner transfer, an ultrasound unit is assigned to the electrostatic doctor blade unit. The release of the toner in particular is thus improved.

In accordance with a further embodiment, the electrostatic or electrographic printing device can also be varied in such a way that the electrostatic doctor blade device is embodied as a roller, which presses the endless belt from the side facing away from the workpiece to be printed on against the latter.

In a further embodiment of the electrostatic or electrographic printing device, the workpiece to be printed on is placed on a conductive plate and a prestress is applied to the plate and the electrostatic doctor blade device, which can be changed by a regulating device for adjusting the toner release. Thus it is possible to specifically match the toner release to the print distance, the type of toner, the plate thickness and the material of which the plate is made.

In a further embodiment, a roller-shaped transfer unit is integrated into the support frame of an upper unit of a screen-printing device, to which an electrostatic pushbutton with an optical photoconductor roller and developer unit is assigned. The circumferential speed of the roller of the transfer unit and its linear movement above the workpiece to be printed on are synchronized. It is possible to convert a screen-printing device to an electrostatic or electrographic printing method in a simple manner and cost-effectively.

BRIEF DESCRIPTION OF THE DRAWINGS

This invention is explained in greater detail in view of embodiments represented in the drawings, wherein.

DESCRIPTION OF PREFERRED EMBODIMENTS

Figure 1:
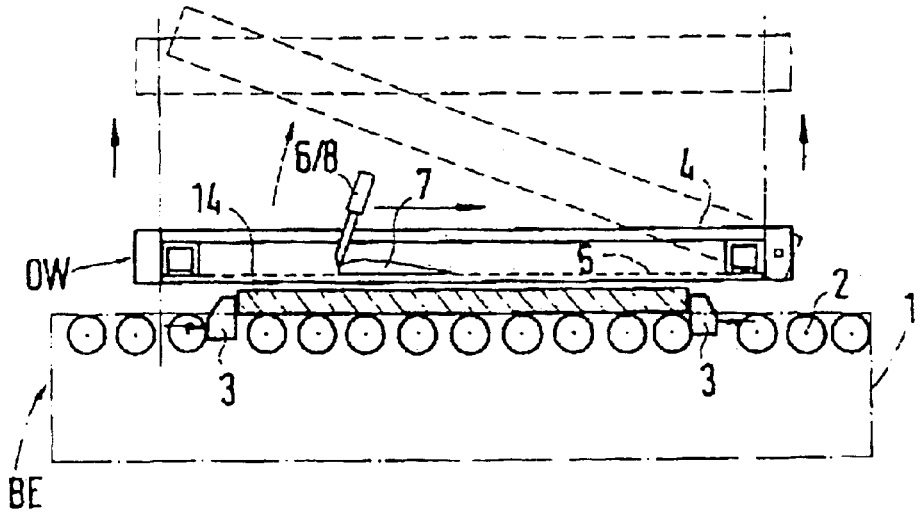
Fig.1 PRIOR ART
FIG. 1 is a diagrammatic view of a screen-printing device having a base unit and an upper unit.

As shown in FIG. 1, a conventional screen-printing device SDE has a base unit BE and an upper unit OW. A conveying unit 2, for example having conveyor rollers or a conveyor belt, and a centering unit 3 are integrated in a table-like structure 1 of the base unit BE. These units are used for the exact feeding and fixing in place during the printing process of the workpieces 14 to be printed on, and are superior to the known electrostatic, in particular electrographic, printing devices in their accuracy, repetitive accuracy and dependability.

The upper unit OW has a support frame 4, into which a screen 5 is placed. The support frame 4 can be lifted off the base unit BE, for a vertical displacement movement or tilting up at one end. A print paste 7 is applied to the screen 5 which, in accordance with the image provided by the screen 5, is transferred in a linear movement 8 by means of a print doctor blade 6 through the screen 5 to the workpiece 14 to be printed on, located on the base unit BE. It is possible to perform the linear movement 8 of the print doctor blade 6 by means of an actuating device, which is known, or manually.

Figure 2:
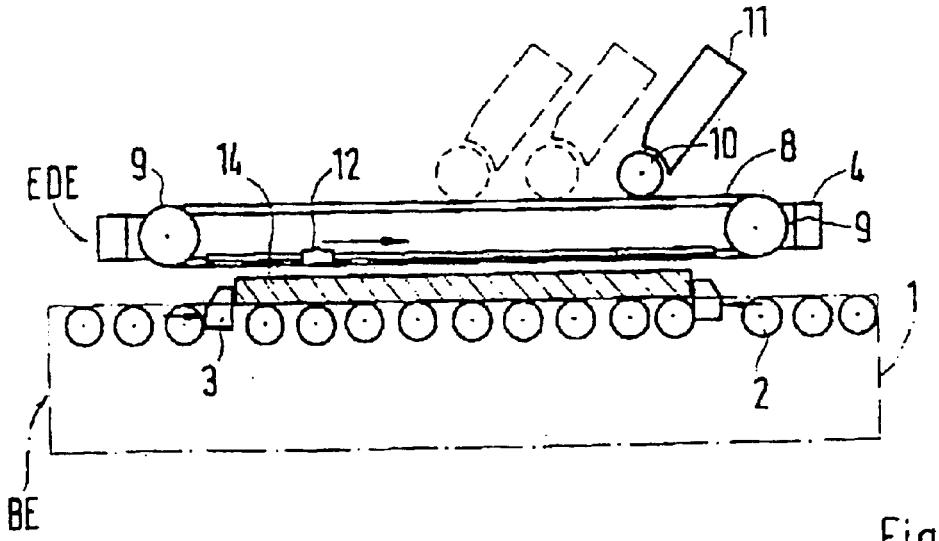
FIG. 2 is a diagrammatic view of a combination of a base unit of a screen-printing device with an electrostatic, in particular an electrographic, printing device.

With the device in accordance with this invention, as shown in FIG. 2, the base unit BE of a known screen-printing device is used, which in a table-like structure has the conveying unit 2 and the centering unit 3 for the workpieces to be printed. An electrostatic or electrographic printing device EDE is used as the upper unit, which is compatible with the upper unit OW of the screen-printing device SDS in accordance with FIG. 1, and which can also have a support frame 4. An endless belt 8 is conducted over two rollers 9 in the support frame 4 and is tensed. An electrostatic pushbutton with an optical photoconductor roller (OPC roller) 10 and a developer unit 11 is arranged in a linearly adjustable manner on the top of the upper run of the endless belt 8. A linearly guided doctor blade unit 12 which, during the printing process, transfers the toner from the endless belt 8 to the workpiece 14, is located on the side of the lower run of the endless belt 8 facing away from the workpiece 14 to be printed on. If required, an ultrasound unit, which assists in the linear toner transfer, can be assigned to the doctor blade unit 12.

Figure 3:
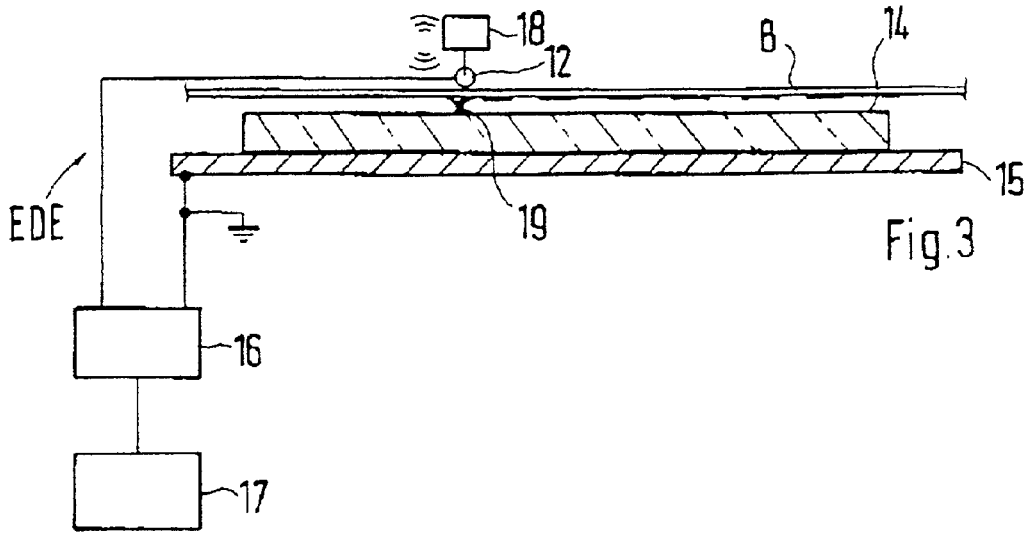
FIG. 3 is a diagrammatic view of an electrostatic, in particular an electrographic, printing device with prestress between the workpiece and the doctor blade unit.

As FIG. 3 shows, the workpiece 14 to be printed on rests during the printing process on a conductive plate 15, which is under prestress 16 in the direction toward the doctor blade unit 12. A regulating unit 17 is assigned to the prestress 16 for changing the prestress 16 in order to match the toner transfer as a function of the printing distance, the type of toner, the plate thickness and the material of the plate. The doctor blade unit 12 with an integrated ultrasound unit 18 contacts the endless belt 8 and improves the toner separation 19. The endless belt 8 is preferably provided with a smooth surface coating on a silicon or Teflon® material. For improving the printing accuracy, the endless belt 8 is a fabric belt of little elongation. By means of doping or of a further coating, its resistance should lie in a range between 10 kΩ/cm to 100 MΩ/cm, preferably between 100 kΩ/cm and 10 MΩ/cm. It is also possible to employ an aluminum belt with a dielectric layer. The endless belt 8 can be directly designed as an optical photoconductor, and therefore can make a photoconductor roller 10 superfluous.

The distance between the endless belt 8 and the workpiece preferably lies between 0 to 1 mm. Because of this, even small differences in flatness, for example with glass or glass-ceramic plates, are not important. The electrostatic doctor blade unit 12 can also be arranged underneath the workpiece 14 to be printed on. In this case the workpiece 14 lies on a dielectric plate. The electrostatic field required for the toner transmission is applied between the doctor blade unit 12 and the conductive endless belt 8.

Figure 4:
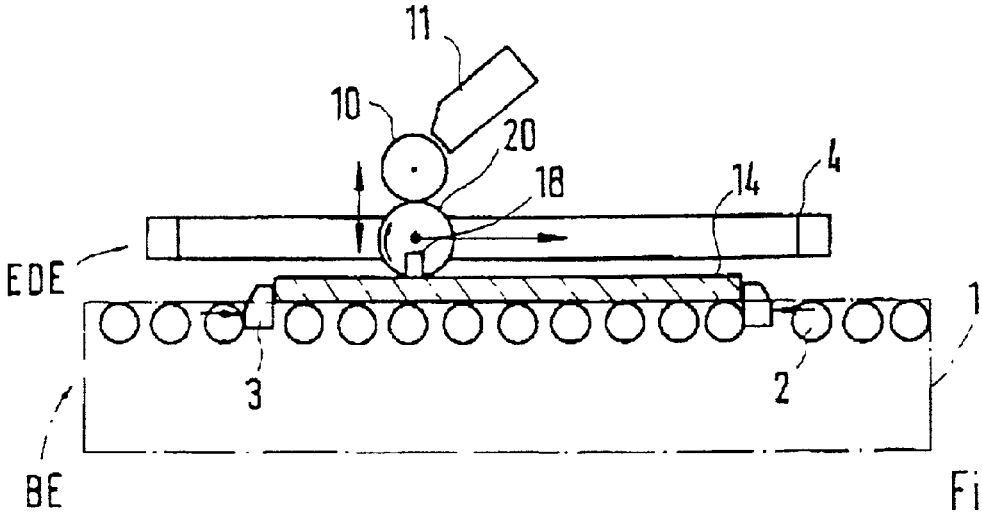
FIG. 4 is a diagrammatic view of a further embodiment of an electrostatic, in particular an electrographic, printing device.

In one embodiment as shown in FIG. 4, the upper unit OW of a screen-printing device is modified in such a way that a transfer unit 20, embodied in a roller shape, is integrated in the doctor blade unit 12 so that it can be linearly moved over the workpiece 14 to be printed on. Thus, the speed of revolution of the roller and the linear movement are synchronous. The roller of the transfer unit 20 rolls over the workpiece 14. Toner transfer is performed by means of an electrostatic field with the assistance of an ultrasound unit 18. A screen-printing device can be converted in a relatively cost-effective manner by means of this embodiment, wherein the workpiece feed and centering, as well as the adjustment of the upper unit with the electrostatic print unit in particular can still be used, unchanged.

In connection with continuous screen-printing tables in a further embodiment, the plate to be printed on is linearly moved underneath the transfer unit (20), which is then stationary.

Figure 5:
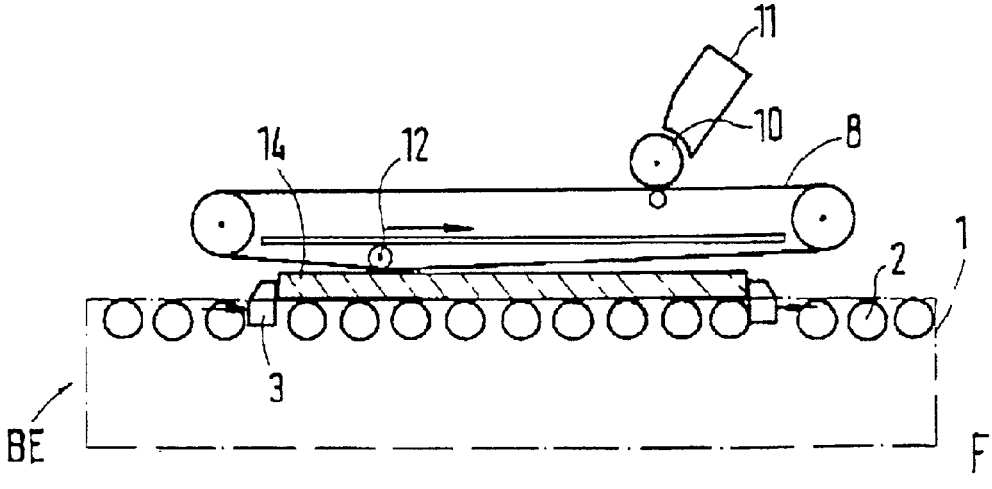
FIG. 5 is a diagrammatic view of a variation of the printing device shown in FIG. 2.

As FIG. 5 shows, the embodiment in accordance with FIG. 2 can also be changed so that the electrostatic doctor blade unit 12, embodied as a roller, is pressed against the workpiece 14 from the direction of the back of the endless belt 8 facing away from the workpiece 14. With this embodiment, an automatic screen lifter, such as is used in connection with flat bed screen-printing devices, for example, is integrated to assure even ink application.

As the various types of embodiment show, the base unit BE can be embodied with a conveying unit 2 and a centering unit 3 in a known manner, since this is of no importance for the combination of the device in accordance with this invention. It should primarily be stressed that the feeding and centering of the workpieces 14 to be printed on is as accurate as possible, and dependability is also assured in case of a repetition.

It remains to be noted, that the printing process can be performed in a known manner and improved in the upper unit OW embodied as an electrostatic printing device.

What is claimed is:

1. In a device for printing on a paper or a plate-shaped material, including a plate made of a glass, a ceramic, a glass-ceramic or a plastic material, having a transport device for the plate to be printed on and having an electrostatic or electrographic printing device arranged above the transport device, the improvement comprising:

a conveying unit (2) feeding the paper or the plate-shaped material with respect to the electrostatic or electrographic printing device (EDE), a centering unit (3) fixing a position of the paper or the plate-shaped material with respect to the electrostatic or electrographic printing device (EDE), and the conveying unit (2) integrated with the centering unit (3) to form the transport device acting with the electrostatic or electrographic printing device (EDE);

wherein the electrostatic or electrographic printing device (EDE) has an endless belt (8) guided over two rollers (9) and the endless belt (8) is tensed, an electrostatic pushbutton with an optical photoconductor roller (10) and a developing unit (11) is arranged above an upper run of the endless belt (8), and on a side of a lower run of the endless belt (8) facing away from the conveying unit (2) and the centering unit (3) a toner can be transferred by a linearly guided electrostatic doctor blade unit (12) from the endless belt (8) to a workpiece (14) to be printed.

2. In the device in accordance with claim 1, wherein the electrostatic or electrographic printing device (EDE) is one of vertically lifted off and tilted up from an end, with respect to the conveying unit (2) and the centering unit (3).

3. In the device in accordance with claim 2, wherein the electrostatic or electrographic printing device (EDE) is arranged in a support frame (4).

4. In the device in accordance with claim 1, wherein the electrostatic or electrographic printing device (EDE) is arranged in a support frame (4).

5. In the device in accordance with claim 1, wherein the endless belt (8) is a coated textile belt and a surface has a layer of one of a silicon and a Teflon® material.

6. In the device in accordance with claim 1, wherein the endless belt (8) is a coated aluminum belt.

7. A device for printing on a paper or plate-shaped material, including a plate made of a glass, a ceramic, a glass-ceramic or a plastic material, the device comprising:

a base unit (BE) including a conveying unit (2) for conveying a workpiece (14) to be printed on, the base unit also including a centering unit (3) for centering the workpiece (14); and an upper unit (OW) including an electrostatic or electrographic printing device (EDE), the electrostatic or electrographic printing device (EDE) including a photoconductor roller (10) having an electrostatic print head and a developer unit (11) and in combination with a transfer element (8, 20), and the electrostatic or electrographic printing device (EDE) including an electrostatic doctor blade unit (12), wherein a toner image is transferred from the transfer element (8, 20) to the workpiece (14) by the electrostatic doctor blade unit (12) guided over the workpiece (14).

8. The device in accordance with claim 7, wherein the transfer element includes an endless belt (8) guided over two rollers (9) and the endless belt (8) is tensed, the photoconductor roller (10) and the developing unit (11) are arranged above an upper run of the endless belt (8), and on a side of a lower run of the endless belt (8) facing away from the conveying unit (2) and the centering unit (3) a toner can be transferred by the electrostatic doctor blade unit (12) from the endless belt (8) to the workpiece (14) to be printed.

9. The device in accordance with claim 8, wherein the endless belt (8) is a coated textile belt and a surface has a layer of one of a silicon and a Teflon® material.

10. The device in accordance with claim 8, wherein the endless belt (8) is a coated aluminum belt.

11. The device in accordance with claim 10, wherein an ultrasound unit (18) is assigned to the electrostatic doctor blade unit (12).

12. The device in accordance with claim 7, wherein an ultrasound unit (18) is assigned to the electrostatic doctor blade unit (12).

13. The device in accordance with claim 7, wherein the electrostatic or electrographic printing device (EDE) includes a support frame (4) which is adapted to be lifted off the base unit (BE).

* * * * *